US005329338A

United States Patent [19]

Merz et al.

[11] Patent Number: 5,329,338

[45] Date of Patent: Jul. 12, 1994

[54] OPTICAL TRANSPARENCY DETECTION AND DISCRIMINATION IN AN ELECTRONIC REPROGRAPHIC PRINTING SYSTEM

[75] Inventors: Eric A. Merz; Jacqueline L. Holmes, both of Rochester; Kenneth G. Christy, Webster, all of N.Y.

[73] Assignee: Xerox Corporation, Stamford, Conn.

[21] Appl. No.: 755,987

[22] Filed: Sep. 6, 1991

[51] Int. Cl.[5] ..... G03G 21/00

[52] U.S. Cl. ..... 355/207; 250/561; 355/311; 356/446

[58] Field of Search ..... 355/308, 311, 316, 317, 355/208, 207; 250/341, 561; 356/73, 445, 446

[56] References Cited

U.S. PATENT DOCUMENTS

| | | | |
|---|---|---|---|
| 4,540,887 | 9/1985 | Minerd et al. . | |
| 4,671,309 | 6/1987 | Iemura et al. | 137/93 |
| 5,005,049 | 4/1991 | Matsushita | 355/208 |
| 5,049,937 | 9/1991 | Takeda | 355/311 X |
| 5,132,736 | 7/1992 | Muramatsu et al. | 355/271 |

FOREIGN PATENT DOCUMENTS

| | | |
|---|---|---|
| 0193777 | 9/1986 | European Pat. Off. . |
| 0200052 | 11/1990 | Japan . |
| 1458282 | 12/1976 | United Kingdom . |

*Primary Examiner*—Lincoln Donovan
*Assistant Examiner*—Christopher Horgan
*Attorney, Agent, or Firm*—Kenyon & Kenyon

[57] ABSTRACT

A method and apparatus for detecting and discriminating a copy sheet in an electronic reprographic printing system has a diffuse reflective sensor disposed adjacent a portion of the path over which the copy sheet moves. The sensor is disposed so that its optical axis intersects the copy sheet where the angle of intersection between the copy sheet and the optical axis remains within a specified range of angles for the maximum length of the copy sheet. A diffuse reflective sensor is also disposed adjacent inlet baffles with its optical axis aligned so that a transparent copy sheet is not detected while an opaque copy sheet is.

16 Claims, 10 Drawing Sheets

OPTICAL TRANSPARENCY DETECTION AND DISCRIMINATION IN AN ELECTRONIC REPROGRAPHIC PRINTING SYSTEM

BACKGROUND OF THE INVENTION

The invention relates generally to a color electronic reprographic printing system, and more particularly concerns a method and apparatus for distinguishing between opaque and transparent sheets to which are applied a plurality of developed images in a color reprographic system and for reliably sensing the presence of a transparent sheet in such a system in which the sheet's movement is not closely controlled.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational area contained within the original document being reproduced. After the electrostatic latent image is recorded on the photoconductive member, the latent image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal to the printing machine where a plurality of toner images is transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

In a color reprographic system, a transparent, polymer copy sheet is developed and fused to different parameters than an opaque, paper copy sheet. It is therefore desirable to distinguish between opaque and transparent copy sheets. As is well known in the art, previous systems have used two-piece transmissive sensors to distinguish copy sheets. Such sensors have an emitter and a photodetector disposed on opposite sides of the path along which the copy sheet moves. An opaque copy sheet interrupts the light transmitted from the emitter to the photodetector while a transparent copy sheet does not. Although this is an effective technique for distinguishing transparent from opaque copy sheets, such sensors are costly, relatively large, cumbersome to locate within the system, and special-purpose. Such sensors are used, for example, in the Canon CLC-1 and CLC-500 color photocopiers.

Another type of sensor, which is commonly used for copy sheet sensing in reprographic systems, is a diffuse reflective sensor. In this sensor, the emitter and photodetector are disposed on the same side of the copy sheet path. A matte black background or open space is disposed on the other side. When no copy sheet is in front of the sensor, light from the emitter is absorbed by the background or open space. When a copy sheet is placed in front of the sensor, light from the emitter is reflected off of the copy sheet and transmitted to the photodetector. In known configurations, such a sensor detects both transparent and opaque copy sheets—it does not distinguish between them. Such a sensor is used, for example, in the Model No. 5046 photocopier manufactured by the Xerox Corporation.

Simply detecting the presence of a transparent copy sheet presents significant difficulties. Mechanical switches placed in the copy sheet path can detect either a transparent or opaque copy sheet. However, such switches are unreliable. As noted above, diffuse reflective sensors can be used to detect both transparent and opaque copy sheets. Opaque copy sheets are readily detected because the reflected light is scattered, or diffused, from the surface of the copy sheet, so that a detectable amount of light will reach the detector over a wide range of angles of the plane of the sheet relative to the axis of the sensor. However, transparent copy sheets produce specular, rather than diffuse, reflection of incident light from the sensor's emitter. Thus, a detectable amount of light will reach the detector only over a narrow range of angles of the sheet plane relative to the sensor axis. This limitation is acceptable in applications in which the copy sheet position is closely controlled. However, this limitation is not acceptable where, as in portions of the copy sheet circulation path of the color reprographic system described herein, the leading and trailing portions of the copy sheet are closely controlled while the body portion is not. In such applications, the known diffuse reflective sensor configuration will not reliably detect transparent copy sheets.

SUMMARY OF THE INVENTION

The problems are overcome by the method and apparatus of the invention. A diffuse reflective sensor is disposed adjacent a portion of the path over which the copy sheet moves. The sensor is disposed so that its optical axis intersects the copy sheet where the angle of intersection between the copy sheet and the optical axis remains within a specified range of angles for the maximum length of the copy sheet. The preferable disposition for the sensor is adjacent a portion of the copy sheet path where the sheet assumes a curved shape because the sheet is more resistant to deflection when it is in such a shape. A diffuse reflective sensor is also disposed adjacent inlet baffles with its optical axis aligned so that a transparent copy sheet is not detected while an opaque copy sheet is. The operation of the two sensors can be combined to provide a jam-checking function. The invention has the advantages that it can detect transparent copy sheets more reliably than mechanical switches and do so in a system in which the body portion of the copy sheet's position is not closely controlled. The invention also provides accurate discrimination between opaque and transparent copy sheets without utilizing bulky and expensive transmissive sensors with the same sensor that is used for detecting both opaque and transparent copy sheets.

DETAILED DESCRIPTION

Figure 1:
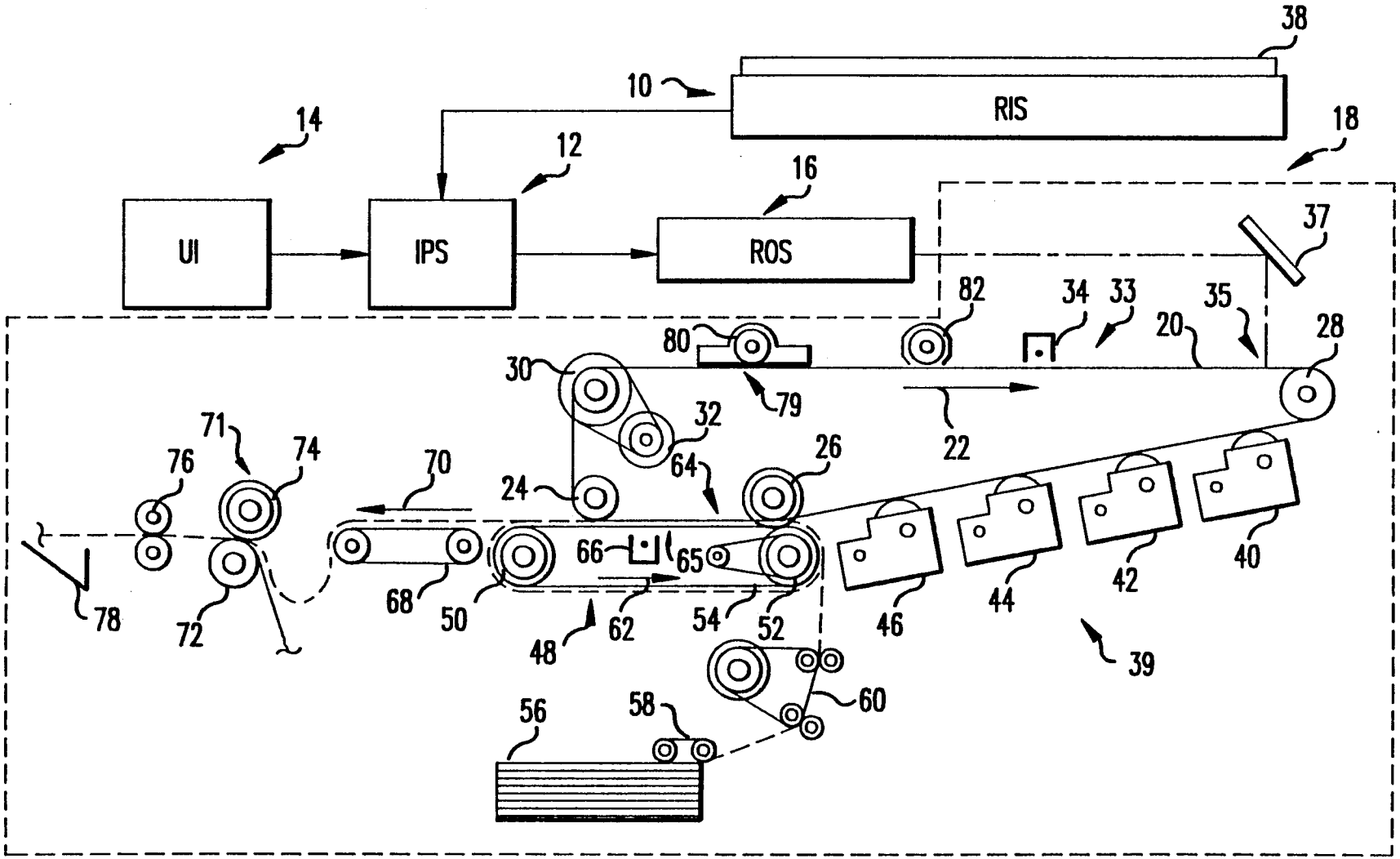
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD) array. The RIS captures the entire original document and converts it to a series of raster scan lines and measures a set of primary color densities, i.e. red, green, and blue densities, at each point of the original document. This information is transmitted to an image processing system (IPS), indicated generally by the reference numeral 12. IPS 12 contains control electronics that prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser and an associated rotating polygon mirror block. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines, which are transmitted as electrical signals to IPS 12. The electrical signals from RIS 10 correspond to the red, green, and blue densities at each point in the original document. IPS 12 converts the set of red, green, and blue density signals, i.e., the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44, and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper or transparent plastic. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper, generally indicated by the reference numeral 84 (see FIGS. 2–7), extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured released by the sheet gripper. Further details of the sheet transport apparatus will be discussed hereinafter with reference to FIGS. 2–7. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Referring now to FIGS. 2–7, sheet gripper 84 is suspended between two spaced apart timing belts 54 mounted on rollers 50 and 52. Timing belts 54 define a continuous path of movement of sheet gripper 84. A servo motor 86 is coupled to roller 52 by a drive belt 88. Sheet gripper 84 includes a pair of guide members 85. A pair of spaced apart and continuous tracks 55 are respectively positioned substantially adjacent belts 54. Tracks 55 are respectively positioned substantially adjacent belts 54. Tracks 55 are respectively defined by a pair of track supports 57. Guide members 85 are slidably positioned within a respective track 55 (see FIGS. 5 and 6). Sheet gripper 84 further includes an upper-sheet gripping portion 87 and a lower sheet gripping portion 89 which are spring biased toward each other. The sheet gripper includes a pair of cams (not shown), which function to open and close the gripping portions at predetermined intervals. In the closed position, gripping portion 87 cooperates with gripping portion 89 to grasp and securely hold the leading edge of sheet 25. The area at which the gripping portions 87 and 89 grasp sheet 25 defines a gripping nip, generally indicated by the reference numeral 91 (see FIGS. 5 and 7). A silicone rubber coating (not shown) may be positioned upon lower sheet gripping portion 89, near gripping nip 91, to increase the frictional grip of sheet 25 between the gripping portions. Belts 54 are respectively connected to the opposed side marginal regions of sheet gripper 84 by a pair of pins 83. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected. In the above configuration, the distance between the leading edge of the sheet and the location at which the sheet gripper is connected to the belts is approximately equal to or greater than one half of the length of the radius of roller 50.

In operation, belts 54 drive sheet gripper 84 at a constant velocity through transfer zone 64. However, when the sheet gripper is being negotiated through a non-linear portion of its path, the sheet gripper may accelerate. The sheet transport system of the present invention provides for decoupling of the acceleration of the sheet gripper from any portion of the sheet in the transfer zone. This is important in order to prevent slip between the copy sheet and the photoconductive belt in the transfer zone and thus provide for accurate transfer of the developed toner image from the photoconductive belt to the copy sheet thereby preserving the integrity of the image produced on the copy sheet.

Figure 2:
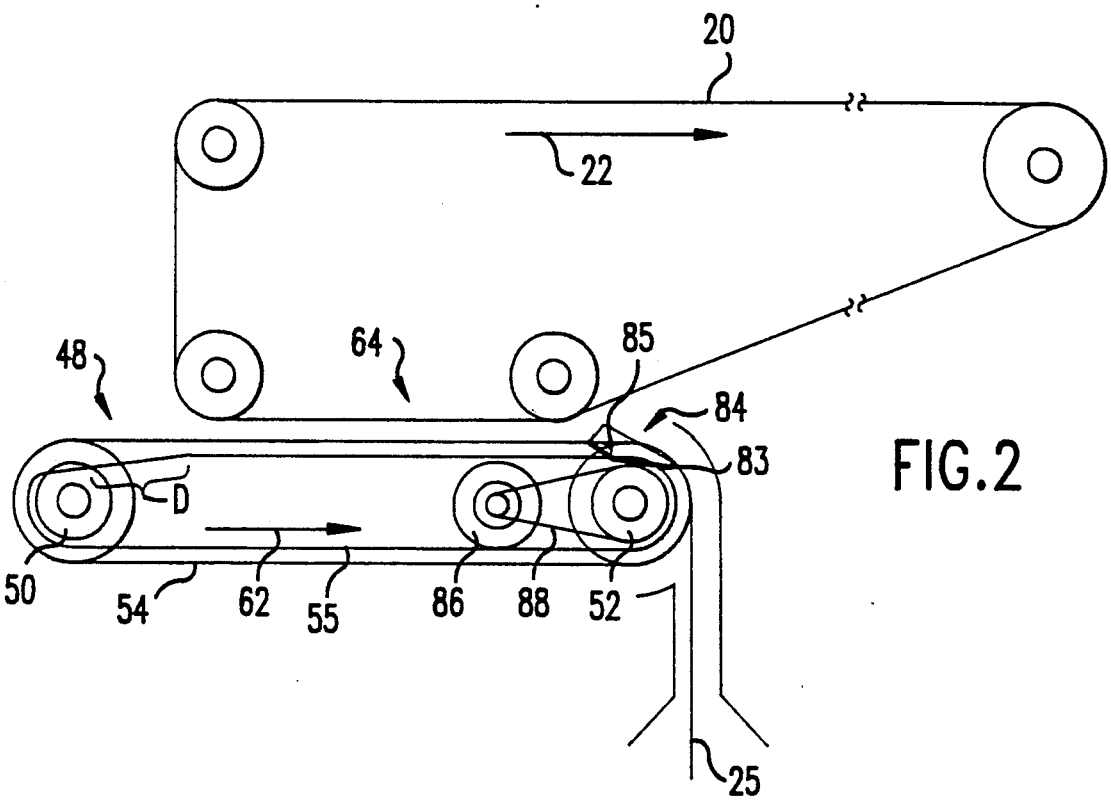
FIG. 2 is a schematic elevational view showing further details of the sheet transport system used in the electrophotographic printing machine of FIG. 1 and also showing the sheet gripper of the sheet transport system at a position prior to entering the transfer zone.
Figure 3:
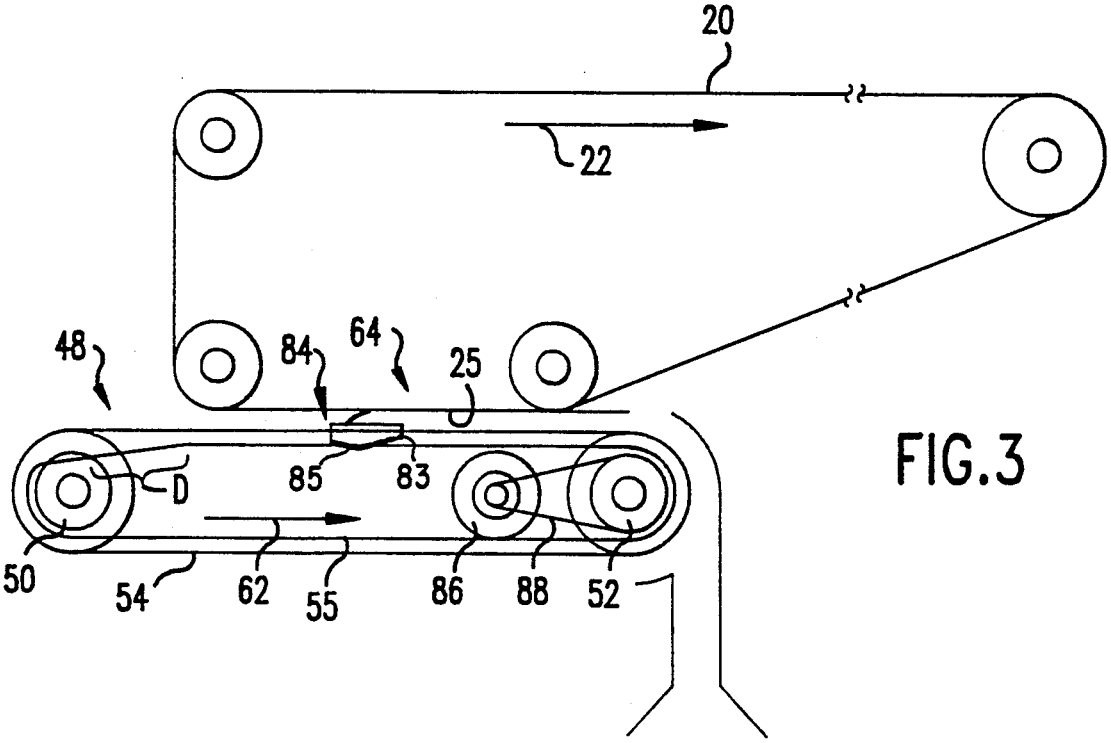
FIG. 3 is a schematic elevational view showing further details of the sheet transport system used in the electrophotographic printing machine of FIG. 1 and also showing the sheet gripper of the sheet transport system at a position within the transfer zone.
Figure 4:
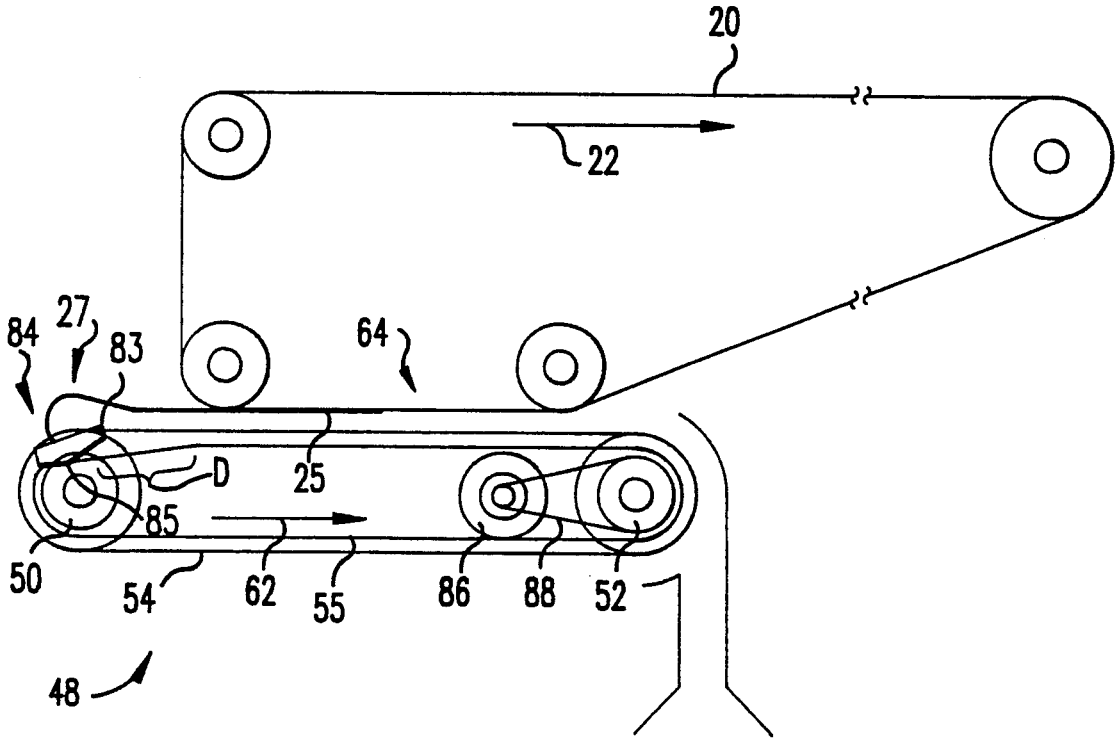
FIG. 4 is a schematic elevational view showing further details of the sheet transport system used in the electrophotographic printing machine of FIG. 1 and also showing the sheet gripper of the sheet transport system at a position after exiting the transfer zone.
Figure 5:
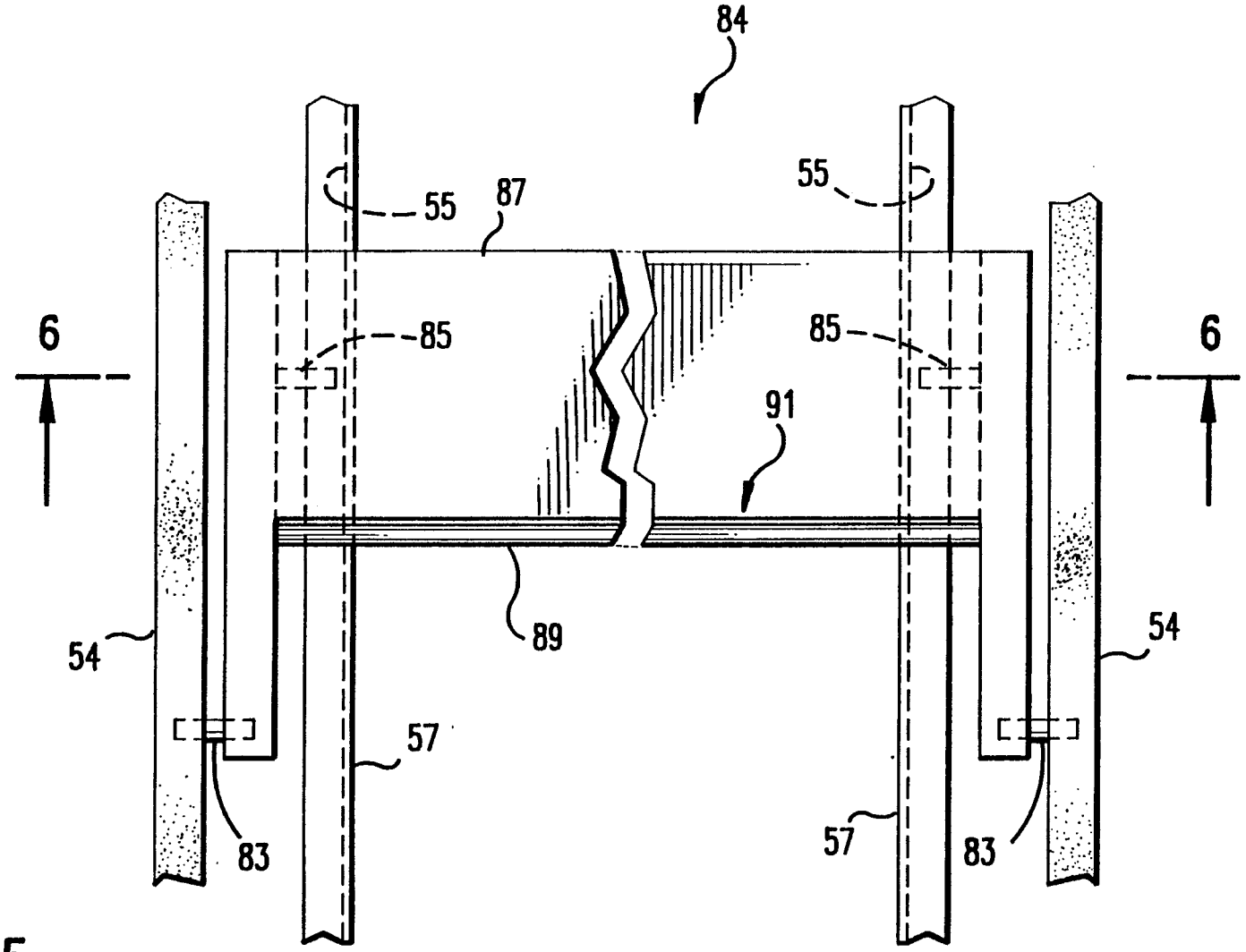
FIG. 5 is a schematic planar view showing the sheet gripper of the sheet transport system used in the electrophotographic printing machine of FIG. 1.
Figure 6:
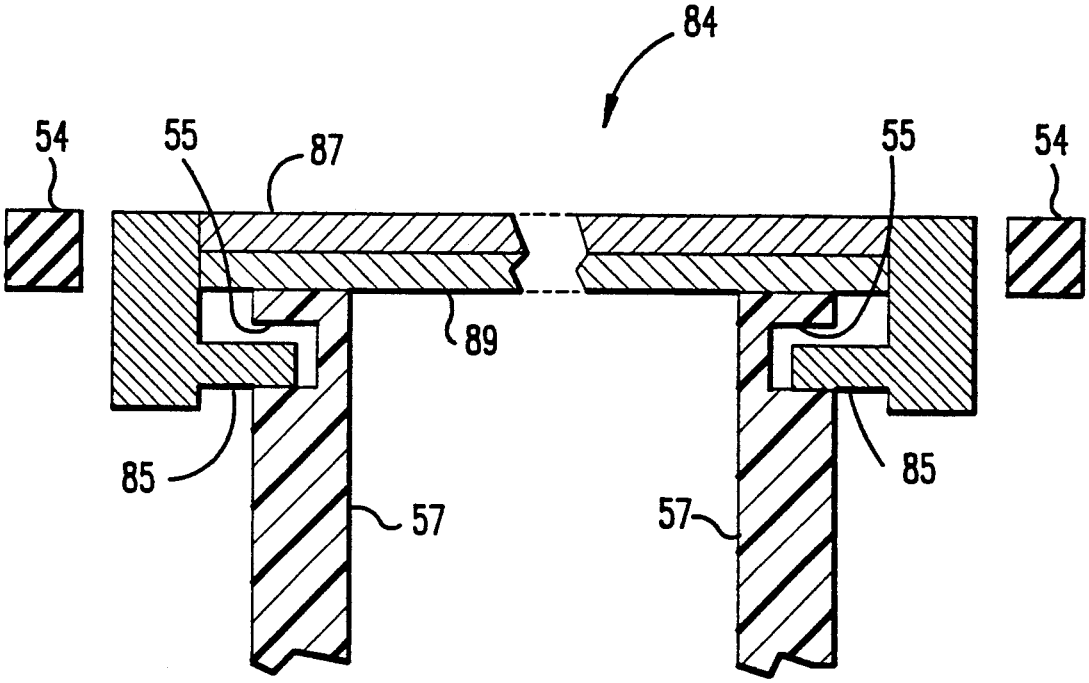
FIG. 6 is a sectional elevational view taken in the direction of arrows 6—6 in FIG. 5.
Figure 7:
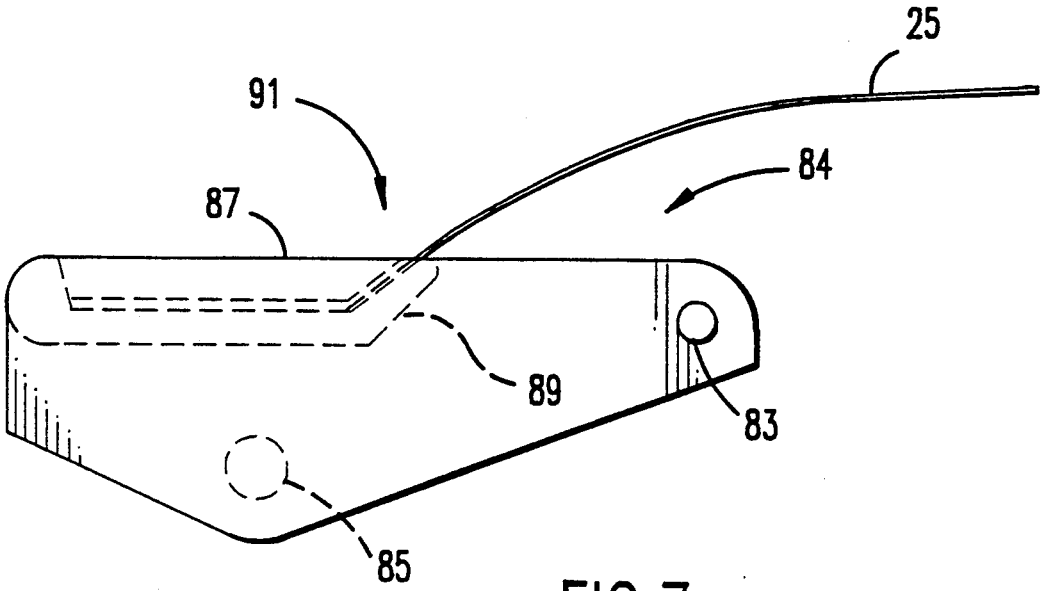
FIG. 7 is a schematic elevational view showing the sheet gripper of the sheet transport system used in the electrophotographic printing machine of FIG. 1.

FIGS. 2–4 depict the movement of sheet gripper 84 from a position before transfer zone 64 to a position after transfer zone 64 relative to the forward direction of movement of belts 54. As the sheet enters the gap between photoconductive belt 20 and the continuous path defined by the movement of sheet gripper 84, the sheet adheres to photoconductive belt 20 as a result of electrostatic forces imparted to the sheet by a corotron (not shown). The sheet travels in this manner through the transfer zone. FIG. 2 shows sheet gripper 84 gripping sheet 25 at about its leading edge prior to entering transfer zone 64. FIG. 3 shows sheet gripper 84 and a leading portion of sheet 25 advanced to a position within transfer zone 64. FIG. 4 shows sheet gripper 84 and the leading portion of sheet 25 at a position immediately ahead of transfer zone 64 relative to the forward direction of movement of belts 54 or photoconductive belt 20, as indicated by arrows 62 and 22 respectively, while a trailing portion of sheet 25 is within transfer zone 64. As shown in FIG. 4, a buckle (indicated generally by reference numeral 27) is formed in a portion of sheet 25 in a region immediately ahead of the transfer zone relative to the forward direction of movement of belts 54 or photoconductive belt 20. Buckle 27 functions to eliminate relative velocity between photoconductive belt 20 and any portion of sheet 25 within the transfer zone so as to substantially eliminate slip between the sheet and the photoconductive belt since an acceleration of the sheet gripper will merely decrease the size of buckle 27 and not transmit the acceleration back to the trailing portion of the sheet remaining in the transfer zone (see FIG. 4).

Figure 8:
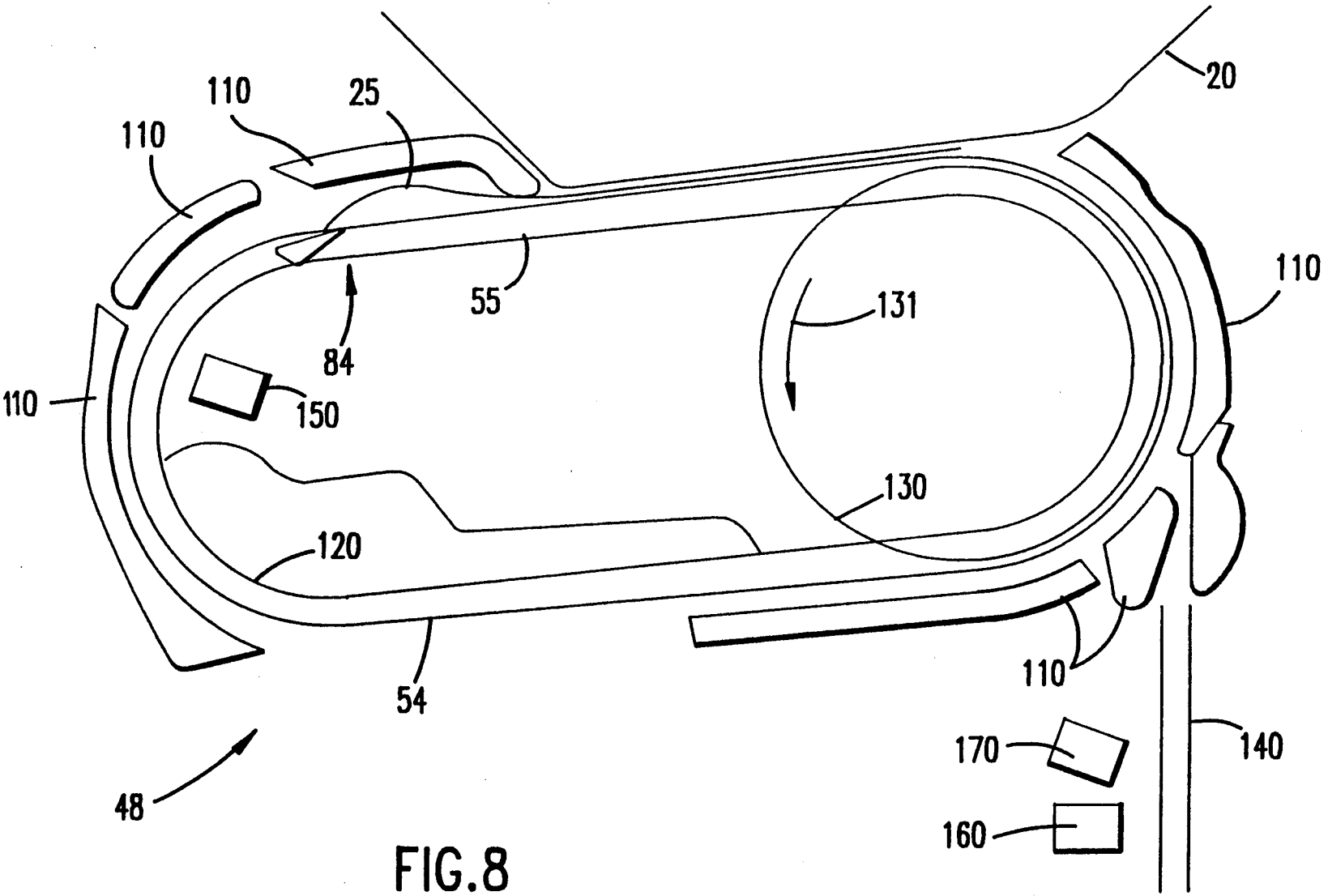
FIG. 8 is a schematic elevational view showing further details of the sheet transport system used in the electrophotographic printing machine of FIG. 1 and also showing vacuum control surfaces and trail edge guides used to control the movement of the copy sheet and the sensors according to the present invention.

FIG. 8 shows another view of the sheet transport system of FIG. 1, in which the vacuum control surfaces and trail edge guides used to control the movement of the copy sheet are shown, as well as the sensors used in accordance with the present invention. As the copy sheet moves around the sheet transport 48, the body portion of the sheet engages, in turn, the photoreceptor belt 20, a stationary vacuum surface 120, and a vacuum drum 130 that rotates in the direction of arrow 131. When the trailing edge of the sheet is not in contact with one of these elements, the beam stiffness of the sheet tends to urge the trailing portion of the sheet straight. Therefore, a series of trail edge guides 110 bound the periphery of the copy sheet's path to engage the trailing edge of the sheet and thereby control the trailing portion of the sheet. In the portions of the copy sheet's path where the trailing edge guides are used to control the sheet's motion, the position of the body portion of the sheet is relatively uncertain—the body portion's position can fluctuate over relatively large distances. A first copy sheet detection sensor 150 is disposed adjacent such a portion of the sheet's path. This sensor is used to detect copy sheet jams in the sheet transport system. If it is known that a copy sheet should be circulating through the transport system, but the sheet detection sensor 150 does not detect a sheet, then the sheet that should be gripped in the sheet gripper is assumed to have jammed in some other portion of the transport system.

The copy sheet enters the sheet transport system via inlet baffles 140. Since the copy sheet does not have any unfused toner on its surface as it passes between the baffles, and contact with fixed surfaces will therefore not disrupt a toner image, the baffles are closely spaced, thus closely controlling the position of the body portion of the copy sheet. A second copy sheet detection sensor 160 and a copy sheet discrimination sensor 170 are disposed adjacent the baffles. The second copy sheet detection sensor confirms that a sheet is entering the sheet transport system. The discrimination sensor determines whether the copy sheet that has entered the system is a transparency or a paper copy sheet.

Figure 9:
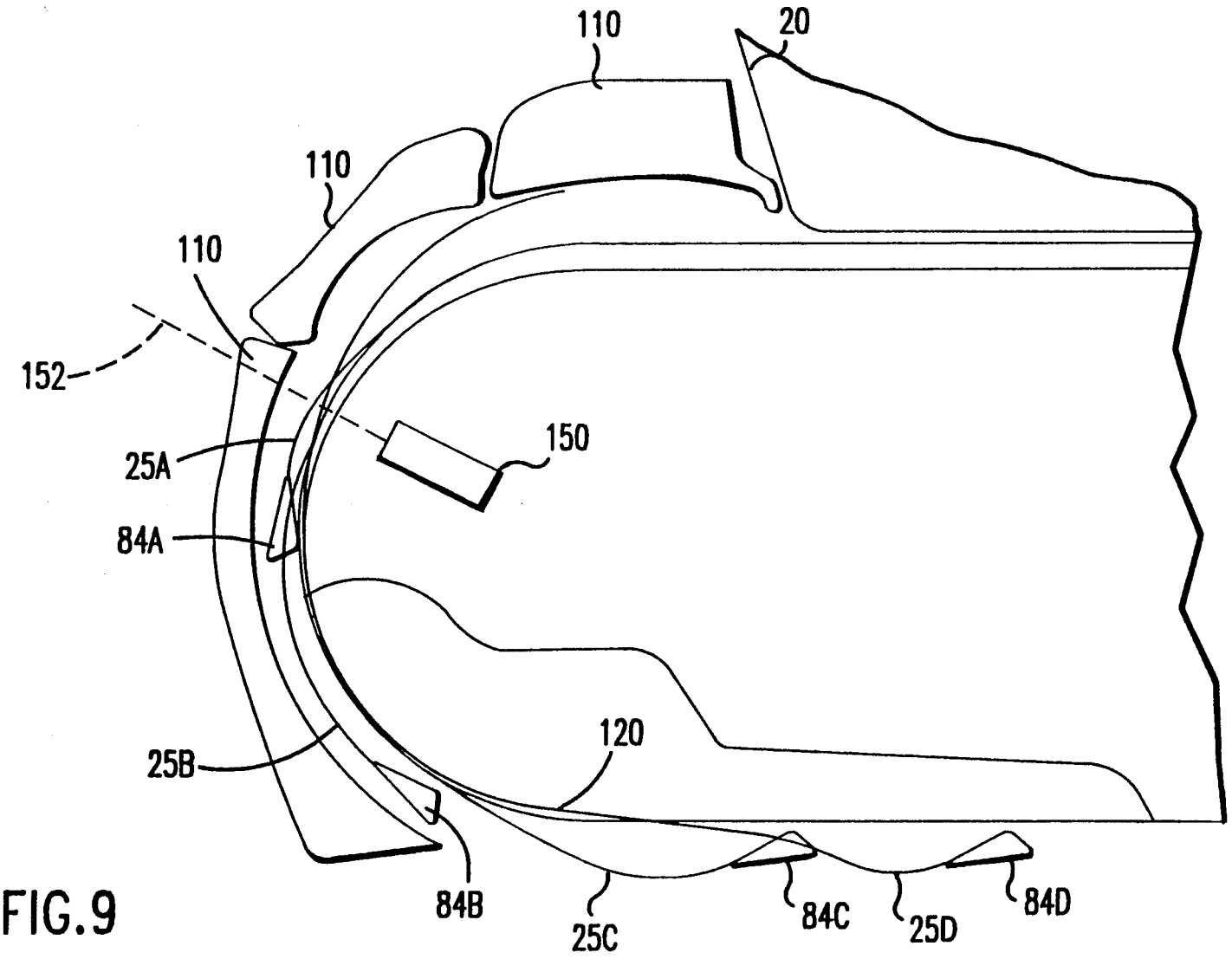
FIG. 9 is a partial schematic elevational view showing further details of the sheet transport system illustrated in FIG. 8 and the movement of a copy sheet through the transport system.

FIG. 9 shows a portion of the sheet transport system of FIG. 8. The sheet gripper 84 is shown in each of four successive positions around the sheet transport system, positions 84A, 84B, 84C, and 84D. The position assumed by the copy sheet 25 gripped in the sheet gripper for each of the four illustrated positions of the sheet gripper is shown as respective copy sheet positions 25A, 25B, 25C, and 25D.

The first copy sheet detection sensor 150 is a diffuse reflective sensor having an optical axis 152. As described above, such sensors detect the presence of an object by sensing light from the emitter reflected off of the object and received by the photodetector. The have an optical focal point lying on the optical axis at which an object is best detected. Similarly, an object is best detected if the intersection of its surface with the sensor's optical axis is normal to the axis. The ability of the sensor to detect the object is degraded as the distance of the object from the sensor varies from the optical focal point and as the intersection of the object's surface with he optical varies from a normal. Further, the reflective characteristics of the object to be sensed affects the sensor's ability to detect the object. Objects such as a white, opaque paper copy sheet reflect a large percentage of incident light in a diffuse fashion—the light is reflected over a large range of angles relative to the angle of incidence of the light to the copy sheet. Conversely, transparent copy sheets reflect light specularly, that is, over a smaller range of angles relative to the angle of incidence. The ability of a sensor to detect an object such as a copy sheet also depends on the time for which reflected light reaches the photodetector—the longer the time, the more easily the object is detected. The sensor's ability to detect a copy sheet depends on the contrast between the copy sheet and the background visible to the sensor when the copy sheet is not disposed before the sensor. The more light-absorptive and the more distant from the optical focal point that the background is, the more the greater the contrast with the copy sheet and thus the easier it is to sense the copy sheet. The sensor's sensitivity can be controlled by varying sensor design parameters. Although a more sensitive sensor will more readily detect a copy sheet, it will also be more susceptible to detecting a background object. Background contrast is thus an important consideration.

In light of these limitations of the diffuse reflective sensors, the difficulties in detecting a copy sheet circulating about the sheet transport system illustrated in FIGS. 8 and 9 become apparent. The photoreceptor belt 20, the stationary vacuum surface 120, and the vacuum drum are all poor backgrounds for the a sensor both because the copy sheet lies along their surfaces (the surface and the copy sheet thus being virtually the same distance from a sensor) and because they are relatively reflective surfaces. A sensor cannot be disposed within these surfaces pointing outwardly toward the paper because the sensor would create a discontinuity in the photoreceptor or vacuum surface, disrupting the toner image. The remaining regions, as explained above, are those in which the body portion of the copy sheet is not well controlled.

Figure 10:
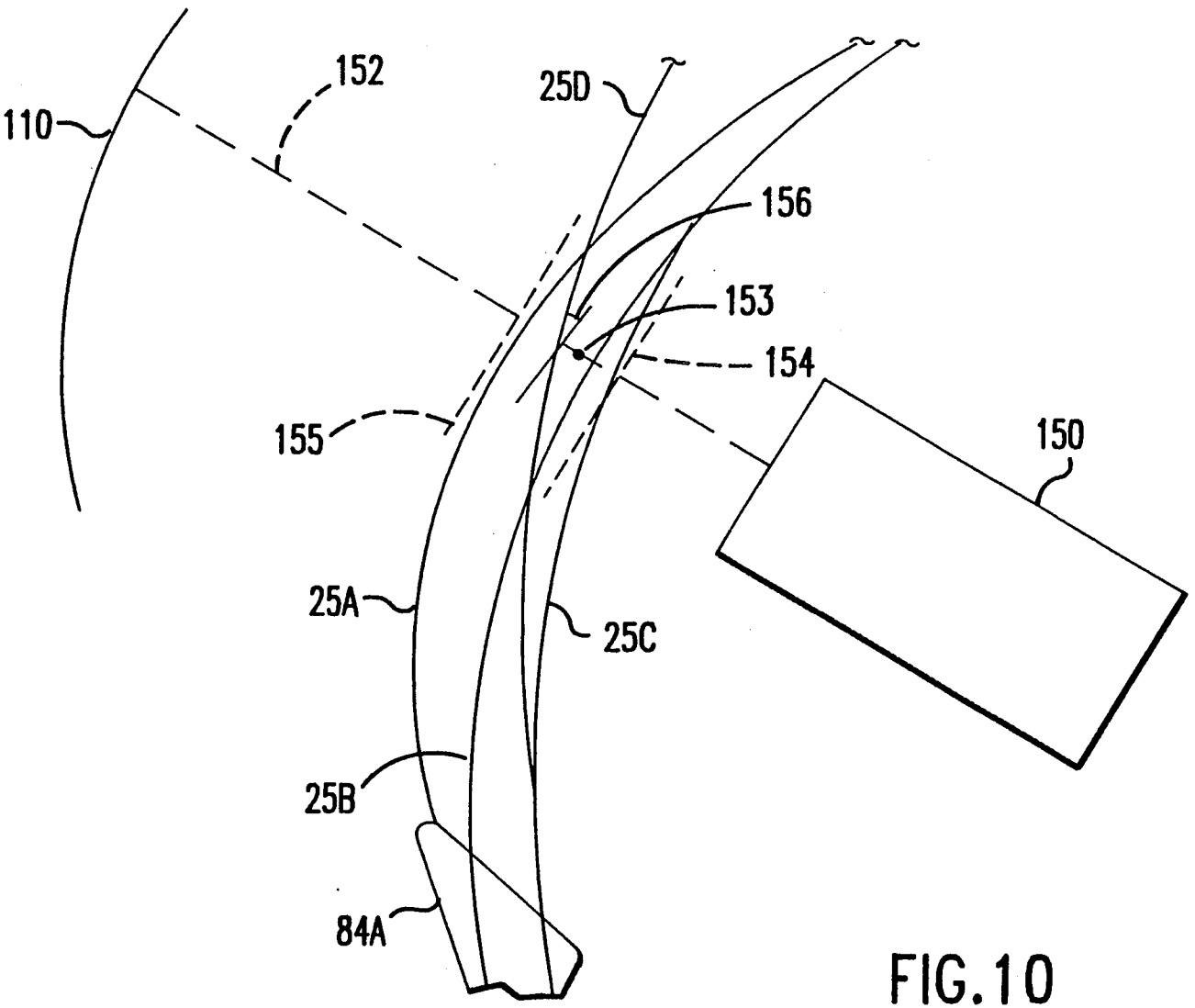
FIG. 10 is a partial schematic elevational view showing further details of the sheet transport system and copy sheet movement illustrated in FIG. 9.

Therefore, in accordance with the present invention, the sensor is disposed in the location where a copy sheet passing through the sensor's optical axis has the least fluctuation of angle from the optical axis and distance from the optical focal point for the greatest amount of time to permit the easiest sensing of the copy sheet. This principle is illustrated in FIG. 10, which shows a portion of FIG. 9. Lines 25A-25D represent the position of the copy sheet corresponding to the positions 84A-84D of the sheet gripper. Each of the sheet positions passes through the optical axis 152 of the sensor 150 at an angle relative to the axis. For example, the angle between sheet position 25D and a line perpendicular to the optical axis is angle 156. Minimum and maximum intersection angles can be defined that bound the largest possible range of intersection angles Similarly, each of the sheet positions passes through the optical axis 152 at some distance from the sensor 150. A range of distances along the optical axis can be defined by an inner boundary 154 and an outer boundary 155 lying about the optical focal point 153. These boundaries bound the points of intersection of the sheet with the optical axis through the largest possible range of the sheet's travel past the optical axis.

The sensor's location and the orientation of its optical axis is selected to maximize the ease of detection of a transparent copy sheet, which, as explained above, is more difficult to detect than an opaque, paper copy sheet. The desired location and orientation are those where the distance between inner and outer boundaries 154 and 155 is smallest, the range between the minimum and maximum intersection angles is smallest, and the time within which the copy sheet intersection with the optical axis falls between the inner and outer boundaries and between the minimum and maximum intersection angles is the greatest. The boundaries and minimum and maximum intersection angles, along with the reflective properties of the copy sheet, constitute performance parameters for the sensor 150.

Figure 12A:
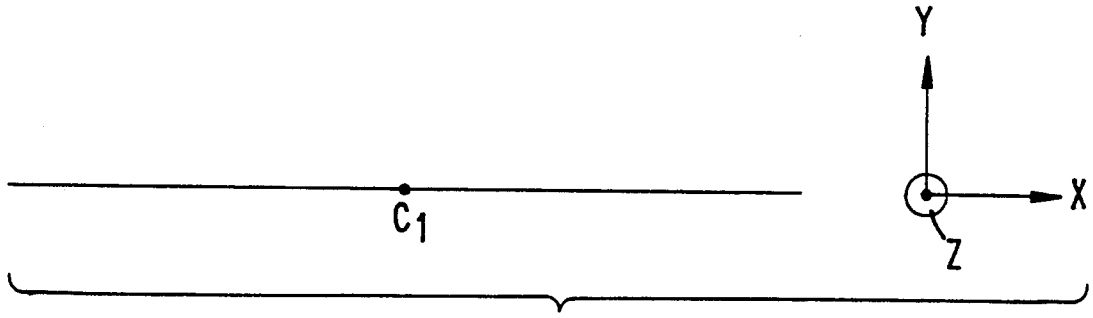
FIGS. 12A and 12B are schematic views of a copy sheet in a straight and curved shape, respectively.
Figure 12B:
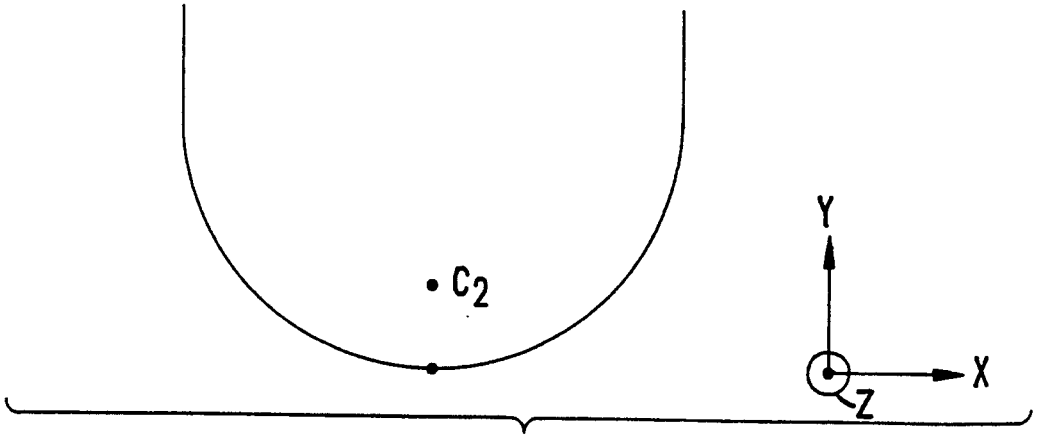

The amount of deflection of a copy sheet in portions of the paper path in which it is not controlled is less in those portions where the copy sheet assumes a curved shape than in those portions where the copy sheet assumes a flat shape. This is because the curved shape offers a higher resistance to bending about two axes than the flat shape. FIGS. 12A and 12B illustrate sectional views of a flat and curved copy sheet, respectively. The centroids of the two sections are indicated as $C_1$ and $C_2$, respectively. The moment of inertia about the X axis is several orders of magnitude higher (for typical copy sheet dimensions) for the curved shape than for the flat shape. Therefore, a given bending force about the X axis produces a much smaller deflection of the curved shape than of the flat shape.

The curved shape is also more resistant to bending about the Z axis than the flat shape. This is because the force required to bend the sheet increases with increasing deflection. Therefore, a given force will deflect a sheet that is already deflected into a curved shape such as shown in FIG. 12B less than it will deflect a flat, undeflected sheet.

Therefore, the amount of deflection of a copy sheet about the X or Z axes produced by a force about those axes is reduced if the copy sheet is in a curved shape rather than a flat shape. Thus, for a copy sheet that is not well controlled, sensing a transparent copy sheet with a diffuse reflective sensor is easier if the copy sheet is placed in a curved shape and the optical axis of the sensor is directed toward the curved sheet. Similarly, if a copy sheet passes through a path having a portion in which the copy sheet is flat and a portion where the copy sheet is curved, the sensor should be disposed so that its optical axis is directed toward the portion of the path where the copy sheet is curved.

In the illustrated embodiment, sensor performance parameters are specified for detection of a transparent copy sheet such as Xerox No. 3R2780 transparency. The sensor, which is an optoelectronic reflective sensor with a Darlington configuration, can detect such a transparency for minimum and maximum intersection angles of ±10° with an inner boundary 8 mm and an outer boundary 13 mm from the sensor. The sensor does not detect black polycarbonate (such as is used for the trail edge guide 110 closest to the sensor) or a material of lower reflectivity at a distance of 38 mm. The sensor provides an on- and off-state photocurrents of 2 and 0.2 Ma, respectively, an on-state collector emitter saturation voltage of 1 V and an off-state collector emitter voltage of 4 V. The sensor changes state within ±3 mm of the optical axis when the transparency is moved through the axis. Sensors having these capabilities are commercially.

Figure 11:
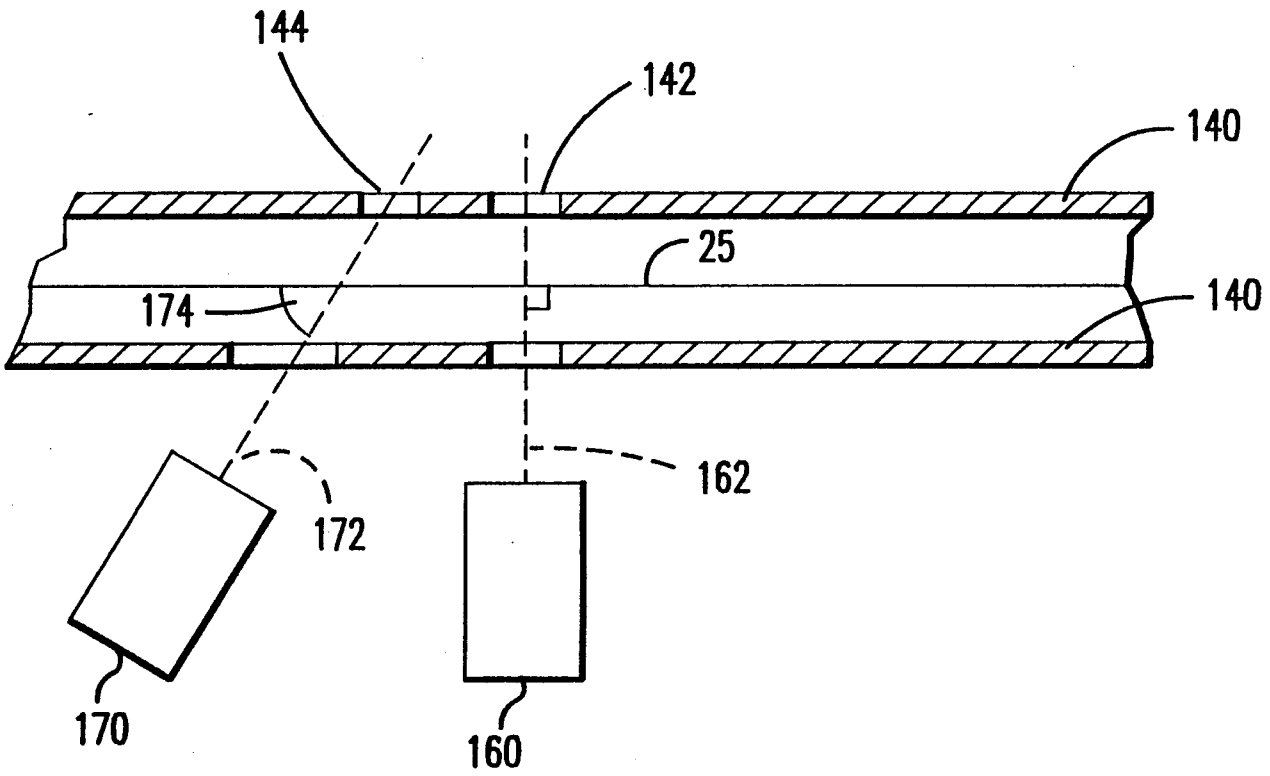
FIG. 11 is a partial schematic elevational view showing further details of the sheet transport system illustrated in FIG. 8.

FIG. 11 shows a schematic representation of the inlet baffles 140 and the sensors 160 and 170. As noted above, when copy sheet 25 is disposed between inlet baffles 140, its position is closely controlled. Since the position and angle of the copy sheet at any given point within the baffles vary little as the copy sheet passes through the baffles, both transparent and opaque copy sheets are readily detectable with a diffuse reflective sensor. Thus, copy sheet detection sensor, a conventional diffuse reflective sensor is disposed adjacent opening 142 in inlet baffles 140 with its optical axis 162 perpendicular to copy sheet 25. So disposed, the detection sensor 160 detects both transparencies and paper copy sheets. However, as discussed above, proper development of images on transparencies requires different treatment for transparencies than paper copy sheets. The reprographic system must therefore distinguish between transparencies and paper copy sheets. This function is performed by distinguishing sensor 170.

Distinguishing sensor 170 is disposed adjacent opening 144 through baffles 140, with its optical axis 172 intersecting the path of the copy sheet 25 at an angle 174. The value of angle 174 is selected such that the sensor can detect paper at that angle but not transparencies. As described above, since light emitted from the sensor is reflected specularly from a transparency, but diffusely from paper, any given sensor at given conditions will be able to detect paper over a wider range of incidence angles than transparencies. The sensor is therefore disposed so that the incidence angle is outside the range in which the sensor can detect a transparency but within the range in which it can detect paper.

In the illustrated embodiment, angle 174 is 64°±5°. At that incidence angle, the distinguishing sensor detects paper for distances up to 9.0 mm but does not detect transparencies between 6.0 and 9.0 mm. Other operating characteristics of the distinguishing sensor are the same as the first detection sensor 150.

The same sensor can be used for both detection sensor 160 and distinguishing sensor 170. The difference in their functions is achieved by the angle of their optical axes with respect to the copy sheet.

The sensors described above can also be used to indicate that a copy sheet has become jammed within the sheet transport system. For example, if sensor 160 detects a copy sheet, but sensor 150 does not, then the sheet has jammed between the inlet baffles and the sensor 150.

While the invention has been described with reference to a specific embodiment, it will be apparent to those skilled in the art that many alternatives, modifications, and variations may be made. Accordingly, it is intended to embrace all such alternatives, modifications that may fall within the spirit and scope of the appended claims.

What is claimed is:

1. An apparatus for detecting a transparent copy sheet, comprising:

(a) means for moving a transparent copy sheet about a circuitous path, the circuitous path having a first portion thereof in which the position of the transparent copy sheet is loosely controlled, the first angle of intersection of the surface of the copy sheet with a fixed axis varying as the copy sheet moves about the circuitous path; and (b) a diffuse reflective sensor disposed adjacent the first portion of the path, said sensor having an optical axis and being capable of detecting a transparent copy sheet for any intersection angle within a predetermined range, the alignment of said optical axis relative to the copy sheet being selected to maximize the length of the copy sheet passing through said optical axis for which said intersection angle is within said predetermined range.

2. The apparatus of claim 1, wherein said predetermined range is between 80° and 100°.

3. The apparatus of claim 1, wherein said sensor is capable of detecting a transparent copy sheet for intersection angles within said predetermined range and for any intersection distance from the intersection of the optical axis and the copy sheet surface that is within a predetermined distance range, the position of said sensor on said optical axis being selected to maximize the length of the copy sheet passing through said optical axis for which said intersection distance is within said predetermined distance range.

4. The apparatus of claim 3, wherein said predetermined distance range is between 8 and 13 mm.

5. A method for detecting a transparent copy sheet, comprising the steps of:

(a) moving a transparent copy sheet about a circuitous path, the circuitous path having a first portion thereof in which the position of the transparent copy sheet is loosely controlled, the first angle of intersection of the surface of the copy sheet with a fixed axis varying as the copy sheet moves about the circuitous path; and (b) disposing a diffuse reflective sensor adjacent the first portion of the path, said sensor having an optical axis and being capable of detecting a transparent copy sheet for any intersection angle within a predetermined range, the alignment of said optical axis relative to the copy sheet being selected to maximize the length of the copy sheet passing through said optical axis for which said intersection angle is within said predetermined range.

6. A method for detecting a transparent copy sheet, comprising the steps of:

(a) moving a transparent copy sheet along a path in which the position of the transparent copy sheet is loosely controlled;

(b) urging the copy sheet into a curved shape along a first portion of said path, said first portion of said path corresponding to said position of the transparent copy sheet in which said sheet is loosely controlled; and (c) disposing a diffuse reflective sensor adjacent said first portion of said path, said sensor having an optical axis, said optical axis being oriented to intersect said copy sheet in said first portion of said path.

7. An apparatus for distinguishing a transparent copy sheet from an opaque copy sheet, comprising:

(a) means for moving a copy sheet along a path;

(b) a diffuse reflective sensor disposed adjacent said path, said sensor having an optical axis, said optical axis being aligned to intersect the surface of the copy sheet at an intersection angle, said sensor being capable of detecting an opaque copy sheet at said intersection angle and being unable to detect a transparent copy sheet at said intersection angle; and (c) a second diffuse reflective sensor disposed adjacent said path and having an optical axis aligned to intersect the surface of the copy sheet at a second intersection angle, said second diffuse reflective sensor being capable of detecting an opaque copy sheet and a transparent copy sheet at said second intersection angle.

8. A method for distinguishing a transparent copy sheet from an opaque copy sheet, comprising the steps of:

(a) moving a copy sheet along a path;

(b) disposing a diffuse reflective sensor adjacent said path, said sensor having an optical axis, said optical axis being aligned to intersect the surface of the copy sheet at a first intersection angle, said sensor being capable of detecting an opaque copy sheet at said intersection angle and being unable to detect a transparent copy sheet at said intersection angle; and (c) disposing a second diffuse reflective sensor adjacent said path, said sensor having an optical axis, said optical axis being aligned to intersect the surface of the copy sheet at a second intersection angle, said second diffuse reflective sensor being capable of detecting an opaque copy sheet and a transparent copy sheet at said second intersection angle.

9. A method for checking for jamming of a transparent copy sheet, comprising the steps of:

(a) moving a transparent copy sheet about a circuitous path, the circuitous path having a first portion thereof in which the position of the transparent copy sheet is loosely controlled, the first angle of intersection of the surface of the copy sheet with a fixed axis varying as the copy sheet moves about the circuitous path;

(b) disposing a first diffuse reflective sensor adjacent the first portion of the path, said first sensor having a first optical axis and being capable of detecting a transparent copy sheet for any intersection angle within a predetermined range, the alignment of said first optical axis relative to the copy sheet being selected to maximize the length of the copy sheet passing through said first optical axis for which said intersection angle is within said predetermined range;

(c) disposing a second diffuse reflective sensor adjacent said path, said second sensor having a second optical axis, said second optical axis being aligned to intersect the surface of the copy sheet at a second intersection angle, said sensor being capable of detecting an opaque copy sheet at said second intersection angle and being unable to detect a transparent copy sheet at said second intersection angle;

(d) disposing a third diffuse reflective sensor adjacent said path and having a third optical axis aligned to intersect the surface of the copy sheet at an third intersection angle, said third sensor being capable of detecting an opaque copy sheet and a transparent copy sheet at said third intersection angle; and (e) indicating a jam if said third sensor detects a copy sheet and said first sensor does not detect a copy sheet.

10. The method of claim 9 further comprising the steps of:

(f) indicating a jam of an opaque copy sheet if said second sensor detects a copy sheet; and (g) indicating a jam of a transparent copy sheet if said second sensor does not detect a copy sheet.

11. The apparatus of claim 7, wherein the first diffuse reflective sensor and the second diffuse reflective sensor cooperate so that the apparatus can determine the entry of the copy sheet into the path, and whether the copy sheet is an opaque sheet or a transparent sheet.

12. The apparatus of claim 7, wherein the intersection angle is an angle of 64°±5°.

13. The apparatus of claim 7, wherein the intersection angle of the optical axis of the first diffuse reflective sensor is 64°±5°, and the intersection angle of the optical axis of the second diffuse reflective sensor is 90°.

14. The method of claim 8, further comprising the step of:

(d) reading the signals from said first and second diffuse reflective sensors to determine the entry of the copy sheet into the path, and to determine whether the copy sheet is an opaque sheet or a transparent sheet.

15. The method of claim 8, wherein the first intersection angle is an angle of 64°±5°.

16. The wherein of claim 8, wherein the intersection angle of the optical axis of the first diffuse reflective sensor is 64°±5°, and the intersection angle of the optical axis of the second diffuse reflective sensor is 90°.

* * * * *

UNITED STATES PATENT AND TRADEMARK OFFICE

CERTIFICATE OF CORRECTION

PATENT NO. : 5,329,338
DATED : July 12, 1994
INVENTOR(S) : Eric A. Merz, et. al.

It is certified that error appears in the above-indentified patent and that said Letters Patent is hereby corrected as shown below:

Column 1, line 30, delete "which".
Column 5, line 44, after "provide" insert --the brush with fresh developer material. Development is achieved by bringing--.
Column 6, line 39, change "released" to --releasably--.
Column 6, line 57, change "documents" to --documents'--.
Column 8, line 28, after "belt" insert --. This is true--.
Column 9, line 19, after "The" insert --sensors--.
Column 9, line 27 change "he optical" to --the optical axis--.
Column 9, line 45, delete "the more".
Column 10, line 16, after "angles" insert --,--.
Column 11 line 22, after "commercially" insert --available--.
Column 14, line 21, change "an" to --a--.
Column 14, line 54, change "wherein" (first occurrence) to -- method--.

Signed and Sealed this

Seventh Day of March, 1995

*Attest:*

*Attesting Officer*

Bruce Lehman

BRUCE LEHMAN

*Commissioner of Patents and Trademarks*